US008672587B2

(12) United States Patent
Mack et al.

(10) Patent No.: US 8,672,587 B2
(45) Date of Patent: Mar. 18, 2014

(54) METHOD AND APPARATUS FOR DRIVING A PILE INTO A SUBSTRATE

(75) Inventors: James Ewart Milligan Mack, Dorset (GB); David Howel Gunter, Creekmoor, Dorset (GB)

(73) Assignee: IHC Sea Steel Limited, Dorset (GB)

( * ) Notice: Subject to any disclaimer, the term of this patent is extended or adjusted under 35 U.S.C. 154(b) by 0 days.

(21) Appl. No.: 13/520,614

(22) PCT Filed: Jan. 4, 2011

(86) PCT No.: PCT/GB2011/050004

§ 371 (c)(1), (2), (4) Date: Jul. 24, 2012

(87) PCT Pub. No.: WO2011/083324

PCT Pub. Date: Jul. 14, 2011

(65) Prior Publication Data

US 2012/0301226 A1 Nov. 29, 2012

(30) Foreign Application Priority Data

Jan. 5, 2010 (GB) ..... 1000096.6

(51) Int. Cl.
*E02D 13/04* (2006.01)

(52) U.S. Cl.
USPC ..... 405/227; 405/228; 405/232

(58) Field of Classification Search
USPC ..... 405/227, 228, 232
See application file for complete search history.

(56) References Cited

U.S. PATENT DOCUMENTS

| | | | | | |
|---|---|---|---|---|---|
| 2,651,181 | A * | 9/1953 | Alcorn et al. | ..... | 405/227 |
| 3,827,508 | A * | 8/1974 | MacKinnon | ..... | 405/232 |
| 4,102,094 | A | 7/1978 | MacKinnon | | |
| 4,127,991 | A * | 12/1978 | Regan | ..... | 405/202 |
| 4,154,552 | A * | 5/1979 | Van Bilderbeek | ..... | 405/233 |
| 4,408,932 | A * | 10/1983 | Cowan | ..... | 405/228 |
| 4,822,212 | A * | 4/1989 | Hall et al. | ..... | 405/227 |
| 6,234,260 | B1 * | 5/2001 | Coast et al. | ..... | 405/232 |
| 6,305,882 | B1 * | 10/2001 | Coast et al. | ..... | 405/232 |
| 6,749,371 | B2 * | 6/2004 | Jones | ..... | 405/232 |
| 7,585,133 | B2 * | 9/2009 | Jones | ..... | 405/228 |
| 2003/0077127 | A1 * | 4/2003 | Jones | ..... | 405/232 |
| 2009/0129870 | A1 * | 5/2009 | Jones | ..... | 405/228 |
| 2011/0211917 | A1 * | 9/2011 | Jones | ..... | 405/232 |

FOREIGN PATENT DOCUMENTS

| | | | |
|---|---|---|---|
| EP | 1036886 | A1 | 9/2000 |
| EP | 1304415 | A1 | 4/2003 |
| WO | WO2006/109018 | A1 | 10/2006 |
| WO | WO2010/015799 | A2 | 2/2010 |
| WO | WO2010/043845 | A1 | 4/2010 |
| WO | WO2010/092351 | A1 | 8/2010 |
| WO | WO2010/112832 | A1 | 10/2010 |

* cited by examiner

*Primary Examiner* — Frederick L Lagman
(74) *Attorney, Agent, or Firm* — Kilpatrick Townsend & Stockton LLP

(57) ABSTRACT

A pile guide (10) for supporting a pile as it is driven into a substrate, comprising: a base frame (12) having a planar substrate-engaging surface (14) and a pile guide member (16) configured to guide a pile in a predetermined direction therethrough as it is driven into a substrate (18), the pile guide member (16) being mounted on the base frame (12) via a plurality of support members (20) extending therebetween; characterised in that at least one of the plurality of support members (20) has an adjustable length, with length adjustment of the or each support member (20) enabling the predetermined direction to be varied relative to the planar substrate-engaging surface (14) of the base frame (12).

8 Claims, 5 Drawing Sheets

METHOD AND APPARATUS FOR DRIVING A PILE INTO A SUBSTRATE

The present invention relates to a method and apparatus for driving a pile into a substrate, particularly but not exclusively an uneven or undulating underwater substrate with localised variations in level.

It is known to provide pile guides for underwater piling, see for example, Sea Steel Limited's range of pile guides as described in WO99/11872 (Fast Frame pile guide), WO01/92645 (Finned Frame/Follower pile guide), WO03/074795 (Orientation Control pile guide) and WO2009/024739 (Inclined Frame pile guide). However, such pile guides are not ideally suited for driving a pile into an uneven or undulating underwater substrate with localised variations in level. This is because such an underwater substrate will have a tendency, to support the pile guide at different angles to the horizontal in different locations, which would result in piles being driven into the substrate in different, non-vertical-orientations. The present invention has been devised to overcome such difficulties.

In accordance with a first aspect of the present invention, there is provided a pile guide for supporting a pile as it is driven into a substrate, comprising: a base frame having a planar substrate-engaging surface; and a pile guide member configured to guide a pile in a predetermined direction therethrough as it is driven into a substrate, the pile guide member being mounted on the base frame via a plurality of support members extending therebetween; characterised in that at least one of the plurality of support members has an adjustable length, with length adjustment of the or each support member enabling the predetermined direction to be varied relative to the planar substrate-engaging surface of the base frame.

In this way, the orientation of the pile guide member relative to the base frame may be altered, for example to accommodate an undulating substrate. The pile guide member may be wholly supported by the plurality of support members, at least during pile driving. There may be at least three support members, for example, four support members. Each of the support members may be equidistant from the pile guide members.

In one arrangement, each of the support members has an adjustable length. There may be at least three adjustable-length support members, for example four adjustable-length support members. The at least three adjustable-length support members may be arranged around the pile guide member to enable components of the predetermined direction to be varied in two different planes each perpendicular to the planar substrate-engaging surface of the base frame.

The two different planes may be mutually orthogonal. Thus, by varying length adjustments of the support members, the predetermined direction of the pile guide member may be able to sweep out a substantially conical profile relative to the base frame. The substantially conical profile may have a maximum half angle of at least 5°.

The or each adjustable-length support member may comprise a joint assembly having a first part coupled to the base frame and a second part, rotatable relative to the first part, coupled to the pile guide member. Such a joint assembly is configured to accommodate changes in orientation of the pile guide member relative to the base frame.

In the joint assembly, one part may comprise a substantially spherical member (e.g. bush) and the other part may comprise a housing (e.g. socket) in which the spherical member is rotatably mounted. The spherical member may be coupled to an elongate member (e.g. rod). In this way the longitudinal axis of the elongate member may pivot relative to the housing as the spherical member rotates therein. The spherical member may have a bore extending therethrough, and part of the elongate member may be a sliding fit inside the bore. Such an arrangement will also accommodate any changes in separation between the second part of the support member and at least one other support member as the orientation of the pile guide member changes in relation to the base frame.

In one form, the pile guide member may be shaped as a simple hollow cylinder. In other forms, the pile guide member may be as disclosed in WO01/92645 for use with piles with stabilising fins, or as disclosed in WO03/074795 for use with piles with orientation control tabs, or as disclosed in WO2007/066078 for use with piles with profiles which interact with corresponding profiles in the pile guide member to resist bursting pressures in the latter. In one particular form, the pile guide member may be as disclosed in WO99/11872 which comprises two portions movable between an operative position and an inoperative position. In the operative position, the two portions may define a hollow cylinder for guiding a pile as it is driven into a substrate. In the inoperative position, the two portions have separated (each by pivoting away around a respective pivot axis from their operative positions) to allow pile driving to continue and drive the pile fully into the substrate by a hammer without the hammer fouling the pile guide member. Each portion of the pile guide member may be supported by a pair of adjustable-length support members, with a pivot axis defined therebetween around which that portion of the pile guide member rotates when moving between the operative and inoperative positions. The pivot axis is configured to tilt relative to the base frame as the length of one or both of the support members is adjusted. The pivot axis may be aligned with the longitudinal axis of the elongate member in the joint assembly.

In accordance with a second aspect of the present invention, there is provided a method of driving a pile into a non-level substrate, comprising: providing a pile guide according to the first aspect of the present invention; positioning the pile guide with the planar substrate-engaging surface of the base frame resting on the non-level substrate; and adjusting the or each support member with an adjustable length to tilt the pile guide member relative to the base frame such that the predetermined direction is aligned substantially vertically when the planar substrate-engaging surface of the base frame rests on the non-level substrate.

The support members may be adjusted when the pile guide is in situ (i.e. positioned with the planar surface-engaging surface of the base frame resting on the non-level substrate), even when the non-level substrate is underwater. Support member length-adjustment may be carried out automatically (e.g. with the aid of a level detector and control circuitry for producing length adjustment signals in response to output from the level detector). Alternatively, support member length-adjustment may be carried out remotely, with external means such as an ROV (remotely operated vehicle) providing feedback on orientation of the pile guide member relative to the vertical.

An embodiment of the invention will now be described, by way of example and with reference to the accompanying Figures in which.

Figure 1:
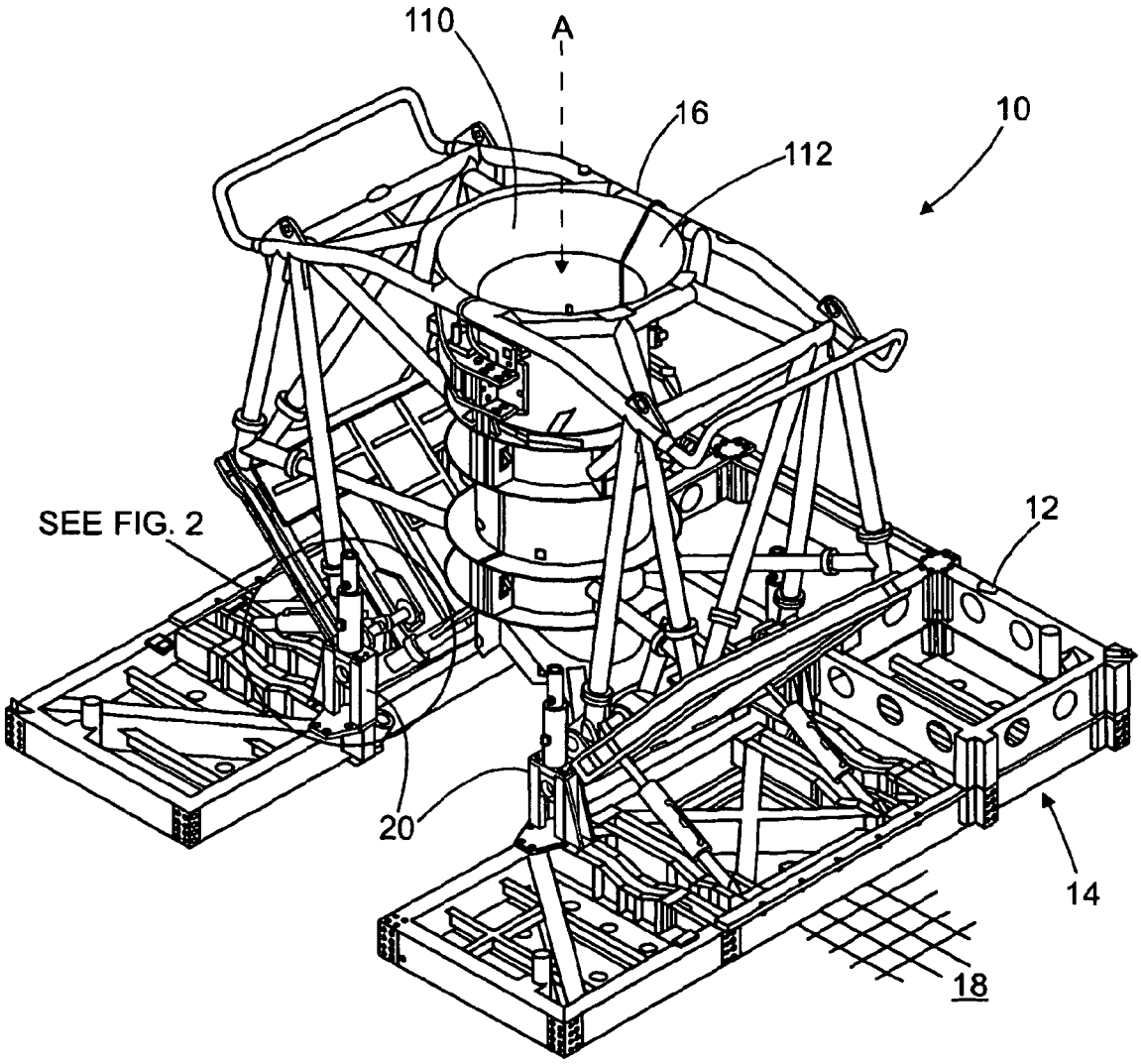
FIG. 1 is a perspective view from the front, one side and above of a pile guide embodying the present invention.

FIG. 1 illustrates a pile guide 10 embodying the present invention. The pile guide 10 comprises a base frame 12 having a continuous planar substrate-engaging surface 14, and a pile guide member 16 configured to guide a pile (not shown) in a predetermined direction (arrow A) relative thereto as it is driven into a substrate 18. The pile guide member 16 is mounted on the base frame 12 via four support members 20 extending therebetween. Each support member 20 has an adjustable length, with adjustments in length enabling the predetermined direction to be varied relative to the planar substrate-engaging surface 14 of the base frame 12.

Figure 3:
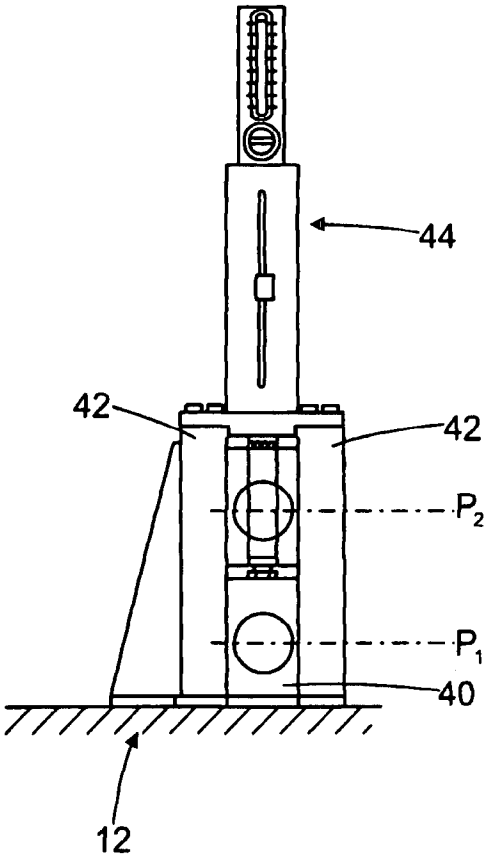
FIG. 3 shows further detail of the part shown in FIG. 2.
Figure 2:
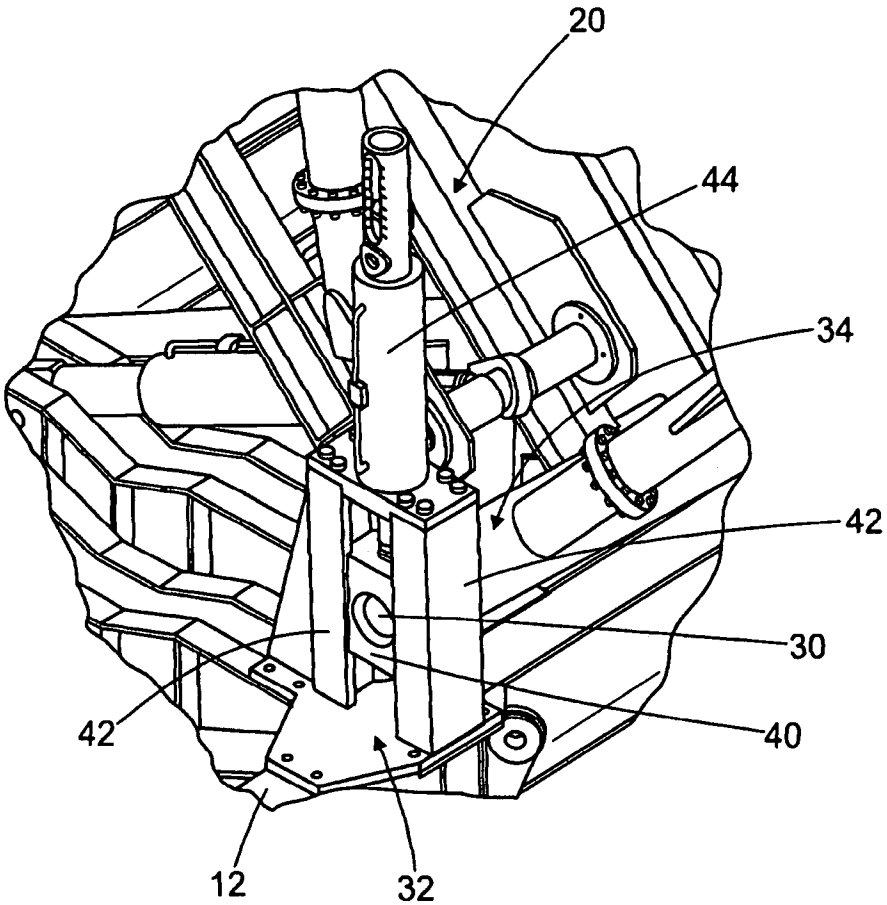
FIG. 2 shows detail of a part of the pile guide ringed in FIG. 1.
Figure 4:
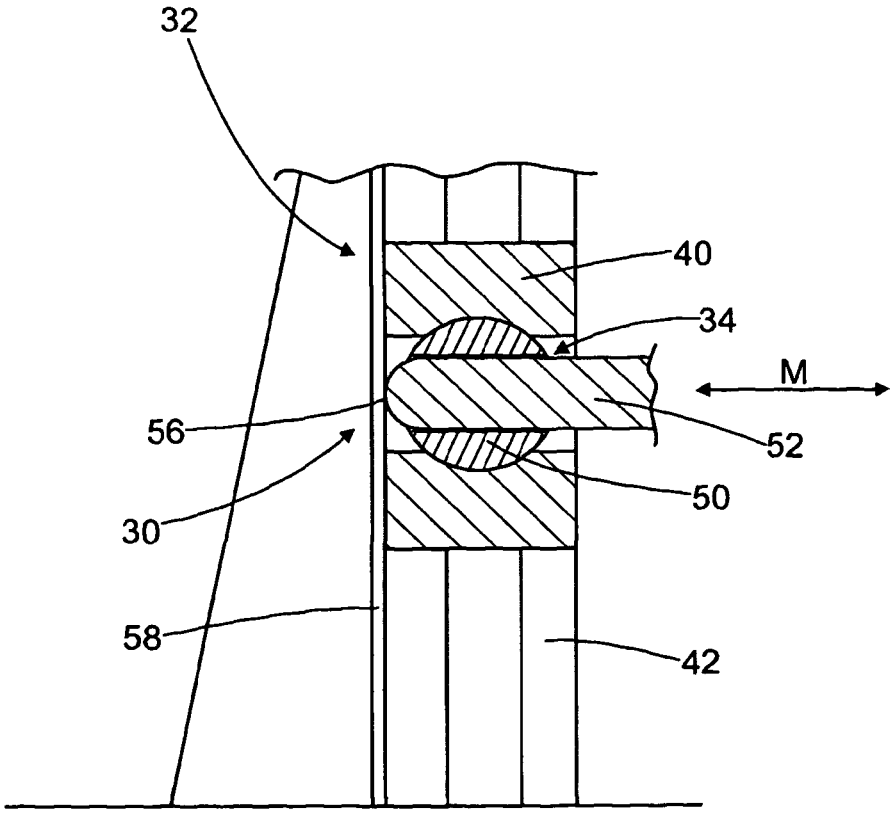
FIG. 4 is a sectional view of the part shown in FIG. 2.

FIGS. 2,3 and 4 show the structure of the adjustable-length support members 20 in more detail. Each adjustable-length support member 20 comprises a joint assembly 30 having a first part or assembly 32 coupled to the base frame 12 and a second part 34, rotatable relative to the first part 32, coupled to the pile guide member 16. The first part 32 includes a housing block 40 slidably received between a pair of guide rails 42 secured to the base frame 12. (In FIG. 2, the guide rails 42 are shown translucent for the sake of clarity). The housing block 40 is movable along the guide rails 42 between a lowest position $P_1$ and a highest position $P_2$, with movement therebetween being controlled by a hydraulic ram 44. The second part 34 includes a partially spherical bush member 50 with an elongate member 52 extending therefrom. The partially spherical bush member 50 is rotatably mounted in the housing block 40 such that the elongate member 52 may pivot relative to the housing block 40.

As shown in FIG. 4, the partially spherical bush member 50 has a bore 54 extending therethrough. One end of the elongate rod member 52 is slidably received in the bore 54, allowing a degree of free movement M of the partially spherical bush member 50 along the elongate rod member 52, as well as rotation of the elongate member 52 within the bore 54. The degree of free movement is limited on one side when a tip 56 of the elongate member 52 engages a backstop 58. The degree of movement is limited on the other side simply by the spacing between adjacent support members 20 which prevents the elongate member 52 pulling out from the bore 54.

Figure 5C:
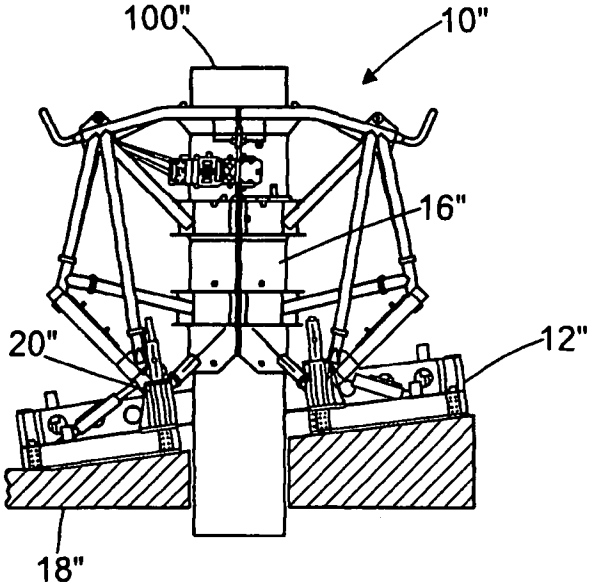
FIGS. 5A-5C are front elevational views of the pile guide of FIG. 1 on different substrate orientations.
Figure 5B:
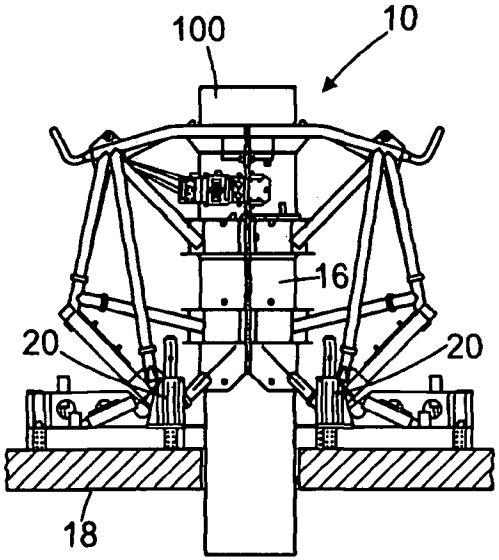
Figure 5A:
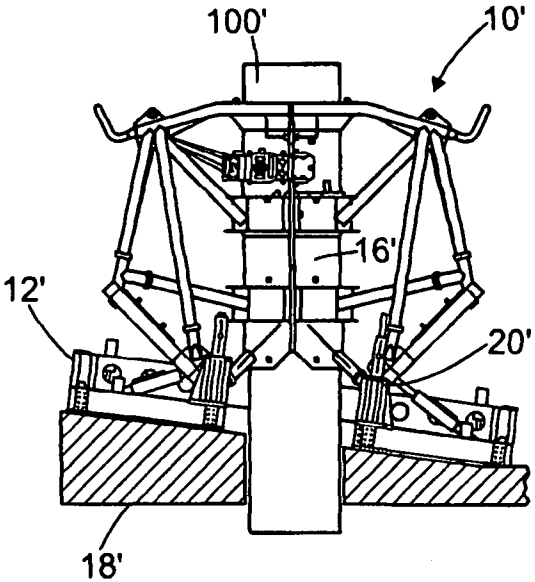

The adjustable-length support members 20 provide a levelling effect, allowing the pile guide member 16 to be moved into a vertical orientation, even when the base frame 12 rests on a non-horizontal substrate 18. The range of the levelling effect is illustrated with reference to FIGS. 5A-5C and FIGS. 6A-6C. FIGS. 5A-5C are front elevations of the pile guide 10, 10', 10", each on a different substrate 18, 18', 18". In FIG. 5B, the pile guide 10 is on a level substrate 18 and all four adjustable-length support members 20 are arranged with their respective housing blocks 40 in their lowest position. In this way, the pile guide member 16 is arranged with the predetermined direction (and pile 100) vertical.

In FIG. 5A, the pile guide 10' is on a downwardly inclined substrate 18' (as viewed from left to right). From the starting position shown in FIG. 5B, the pair of adjustable-length support members 20' on the right-hand side (as viewed in FIG. 5A) of the pile guide 10' are extended by raising their respective housing blocks 40 from their lowest position to their highest position. In this way, the pile guide member 16' is tilted anticlockwise relative to the base frame 12 such that the predetermined direction (and pile 100') is vertical. As the pile guide member 16' tilts anticlockwise, the partially spherical bush members 50 rotate in their respective housing blocks 40, and/or the elongate members 52 rotate in the bores 54 of their respective partially spherical bush members 50, to accommodate the changing position of the pile guide member 16' relative to the base frame 12'.

In FIG. 5C, the pile guide 10" is on an upwardly inclined substrate 18" (as viewed from left to right). From the starting position in FIG. 5B, the pair of adjustable-length support members 20" on the left-hand side (as viewed in FIG. 5C) of the pile guide 10 are extended by raising their respective housing blocks 40 from their lowest position to, their highest position. In this way, the pile guide member 16" is tilted clockwise relative to the base frame 12 such that the predetermined direction (and pile 100") is vertical. As the pile guide member 16" tilts clockwise, the partially spherical bush members 50 rotate in their respective housing blocks 40, and/or the elongate members 52 rotate in the bores 54 of their respective partially spherical bush members 50, to accommodate the changing position of the pile guide member 16" relative to the base frame 12".

Figure 6C:
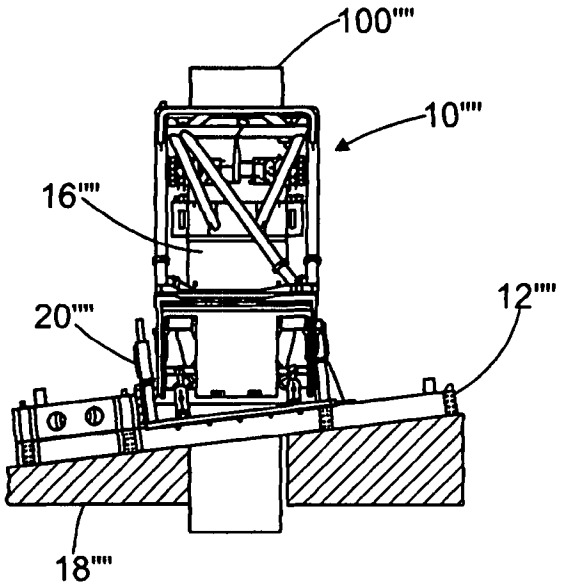
FIGS. 6A-6C are side elevational views of the pile guide of FIG. 1 on different substrate orientations.
Figure 6B:
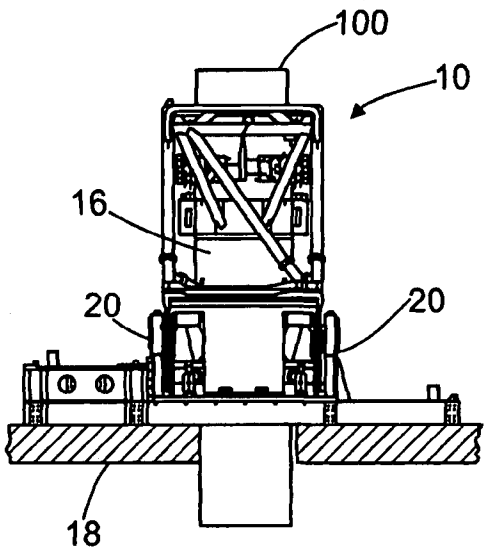
Figure 6A:
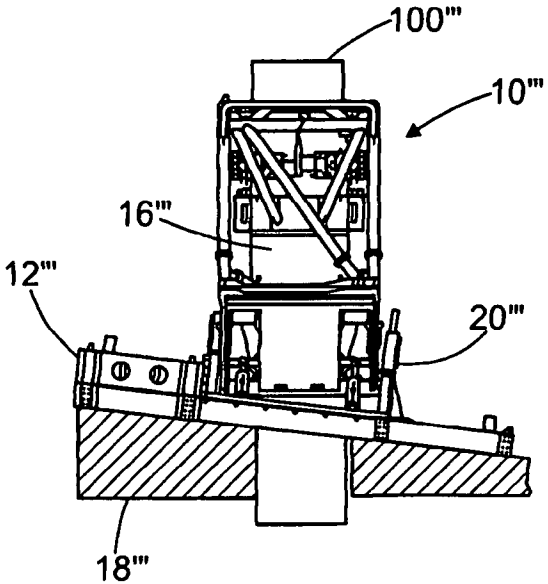

FIGS. 6A-6C are side elevations of the pile guide 10, 10''', 10'''', each on a different substrate 18, 18''', 18''''. As viewed, the back of the pile guide 10, 10''', 10'''' is on the left hand side and the front on the right hand side. In FIG. 6B, the pile guide 10 is on a level substrate 18 and all four adjustable-length support members 20 are arranged as in FIG. 5B. In FIG. 6A, the pile guide 10''' is on a downwardly inclined substrate 18''' (as viewed, with the back of the pile guide 10''' higher than the front). From the starting position shown in FIG. 6B, the pair of adjustable-length support members 20''' on the front of the pile guide 10''' are extended by raising their respective housing blocks 40 from their lowest position to their highest position, in order to tilt the pile guide member (16''' (and pile 100''') into a vertical orientation. As the pile guide member 16''' tilts, the partially spherical bush members 50 rotate in their respective housing blocks 40, and/or the elongate members 52 slide axially in the bores 54 of their respective partially spherical bush members 50, to accommodate the changing position of the pile guide member 16''' relative to the base frame 12'''.

In FIG. 6C, the pile guide 10'''' is on an upwardly inclined substrate 18'''' (as viewed, with the back of the pile guide 10'''' lower than the front). From the starting position shown in FIG. 6B, the pair of adjustable length support members 20'''' on the back of the pile guide 10'''' are extended by raising their respective housing blocks 40 from their lowest position to their highest position, in order to tilt the pile guide member 16'''' (and pile 100'''') into a vertical orientation. As the pile guide member 16" tilts, the partially spherical bush members 50 rotate in their respective housing blocks 40, and/or the elongate members slide axially in the bores 54 of their respective partially spherical bush members 50, to accommodate the changing position of the pile guide member 16'''' relative to the base frame 12''''.

It must be borne in mind that FIGS. 5A-5C and 6A-6C merely illustrate the limits of movement of the pile guide member 16 from left to right (in one plane) and from front to back (in another plane). By combining movement in both planes, it will be possible to position the pile guide member 16 relative to base 12 in between the extremes illustrated.

The pile guide member 16 is configured in accordance with the teachings of WO99/11872 (the entire contents of which are incorporated herein by reference). The pile guide member 16 comprises two parts 110, 112, each movable around a respective pivot axis between an operative position (as shown in FIG. 1) and an inoperative position (not shown). In the operative position, the two parts 110, 112 define a hollow cylinder for guiding a pile guide as it is driven into a substrate. In the inoperative position, the two parts 110, 112 have pivoted away from each other (about their respective pivot axes) to allow pile driving to continue with interference from the pile guide and drive the pile fully into the substrate. The pivot axis of each part 110, 112 is defined by the elongate members 52 from the joint assembly 30 of a respective pair of support members 20. In this way, the joint assembly 30 of each support member 20 accommodates movement of the pile guide member relative to the base frame not only before pile driving when levelling i.e. tilting the pile guide member into vertical orientation, but also during pile driving when the pile guide member moves from its operative position into its inoperative position.

In another form (not shown), the pile guide member may be configured in accordance with the teachings of WO 01/92645 (the entire contents of which are incorporated herein by reference). In other words, the pile guide member may comprise a pair of upright guide channels for receiving and guiding a pair of stabilizing fins associated with a finned pile during pile driving. In yet another form (not shown), the pile guide member may be configured in accordance with the teachings of WO 03/074795 (the entire contents of which are incorporated herein by reference). In other words, the pile guide member may comprise a pair of helical guide plates of opposite senses of rotation which define a tapering channel for correcting any angular misorientation of a pile with a corresponding profile which engages part of the helical guide plates when passing through the pile guide member. In still yet another form (not shown), the pile guide member may be configured in accordance with the teachings of WO 2007/066078 (the entire contents of which are incorporated herein by reference). In other words, the pile guide member may have in its periphery a slot which is configured to allow a laterally protruding coupling attached to a pile to pass along the slot as the pile passes through the pile guide member. The pile guide member has a pair of profiles which are engaged by corresponding profiles on the pile as the pile passes through the pile guide, with reaction forces between opposing profiles resisting gaping of the slot.

The invention claimed is:

1. A pile guide for supporting a pile as it is driven into a substrate, comprising:

a base frame having a planar substrate-engaging surface; and a pile guide member configured to guide a pile in a predetermined direction therethrough as it is driven into a substrate, the pile guide member being mounted on the base frame via a plurality of support members extending therebetween;

wherein at least one of the plurality of support members has an adjustable length, with length adjustment of the or each support member enabling the predetermined direction to be varied relative to the planar substrate-engaging surface of the base frame, with the or each adjustable-length support member comprising a joint assembly having a first part coupled to the base frame and a second part, rotatable relative to the first part, coupled to the pile guide member, with one part comprising an at least partially spherical member with an elongate member extending therefrom, and the other part comprising a housing in which the at least partially spherical member is rotatably mounted.

2. A pile guide according to claim 1, in which the plurality of support members comprise at least three support members.

3. A pile guide according to claim 2, in which each support member has an adjustable length.

4. A pile guide according to claim 3, in which the at least three adjustable length support members are spaced around the pile guide member to enable components of the predetermined direction to be varied in two different planes each perpendicular to the planar substrate-engaging surface of the base frame.

5. A pile guide according to claim 4, in which the two different planes are mutually orthogonal.

6. A pile guide according to claim 1, in which the at least partially spherical member has a bore extending therethrough for slidably receiving at least part of the elongate member.

7. A pile guide member according to claim 1, in which the pile guide member comprises two portions, each pivotally movable about a respective pivot axis between an operative position and an inoperative position, with the pivot axis of one portion being defined by the elongate member extending from the at least partially spherical member.

8. A method of driving a pile into a non-level substrate, comprising:

providing a pile guide comprising: a base frame having a planar substrate-engaging surface; and a pile guide member configured to guide a pile in a predetermined direction therethrough as it is driven into a substrate, the pile guide member being mounted on the base frame via a plurality of support members extending therebetween; wherein at least one of the plurality of support members has an adjustable length, with length adjustment of the or each support member enabling the predetermined direction to be varied relative to the planar substrate-engaging surface of the base frame, with the or each adjustable-length support member comprising a joint assembly having a first part coupled to the base frame and a second part, rotatable relative to the first part, coupled to the pile guide member, with one part comprising an at least partially spherical member with an elongate member extending therefrom, and the other part comprising a housing in which the at least partially spherical member is rotatably mounted;

positioning the pile guide with the planar substrate-engaging surface of the base frame resting on the non-level substrate; and adjusting the or each support member with an adjustable length to tilt the pile guide member relative to the base frame such that the predetermined direction is aligned substantially vertically when the planar substrate-engaging surface of the base frame rests on the non-level substrate.

* * * * *